United States Patent [19]

Schranz et al.

[11] Patent Number: 4,740,446

[45] Date of Patent: Apr. 26, 1988

[54] HEAT DEVELOPMENT PROCESS AND COLOR PHOTOGRAPHIC RECORDING MATERIAL SUITABLE FOR THIS PROCESS

[75] Inventors: Karl-Wilhelm Schranz, Odenthal-Hahnenberg; Günther Schenk, Cologne, both of Fed. Rep. of Germany

[73] Assignee: Agfa Gevaert Aktiengesellschaft, Leverkusen, Fed. Rep. of Germany

[21] Appl. No.: 925,792

[22] Filed: Oct. 31, 1986

[30] Foreign Application Priority Data

Nov. 12, 1985 [DE] Fed. Rep. of Germany ..... 3539996

[51] Int. Cl.[4] ..... G03C 5/54; G03C 7/26

[52] U.S. Cl. ..... 430/203; 430/218; 430/559; 430/617; 430/619

[58] Field of Search ..... 430/203, 218, 617, 619, 430/559

[56] References Cited

U.S. PATENT DOCUMENTS

| | | | |
|---|---|---|---|
| 2,857,276 | 10/1958 | Land | 430/251 |
| 3,846,136 | 11/1974 | Sullivan | 430/617 |
| 4,022,617 | 5/1977 | McGuckin | 430/203 |
| 4,124,387 | 11/1978 | Kohrt | 430/203 |
| 4,639,407 | 11/1987 | Aono et al. | 430/203 |
| 4,639,414 | 1/1987 | Sakaguchi | 430/203 |

FOREIGN PATENT DOCUMENTS

| | | | |
|---|---|---|---|
| 0225153 | 11/1985 | Japan | 430/203 |

*Primary Examiner*—Richard L. Schitting

*Attorney, Agent, or Firm*—Connolly and Hutz

[57] ABSTRACT

Compounds corresponding to formula I are suitable for use as thermal development and diffusion promoting agents for the heat development process. The said compounds enable higher color transfer densities to be obtained and/or the development time to be reduced.

(I)

wherein $R^1$, $R^2$ denote alkyl, cycloalkyl, aralkyl, aryl or acyl and

Z denotes a group for completing a saturated heterocyclic ring containing 5 to 11 ring members.

7 Claims, No Drawings

HEAT DEVELOPMENT PROCESS AND COLOR PHOTOGRAPHIC RECORDING MATERIAL SUITABLE FOR THIS PROCESS

This invention relates to a heat development process in which an imagewise exposed colour photographic recording material containing a layer of binder with silver halide and at least one colour producing compound on a common layer support is subjected to development by heat treatment in contact with an image receptor layer which may be an integral component of the recording material or may be arranged on a separate layer support, at least one so-called thermal development and diffusion-promoting agent being present.

It is known to produce colour images by heat treatment by means of suitable colour photographic recording materials. Particularly suitable colour producing compounds are those which can be incorporated in a non-diffusible form in the layer of a photographic recording material and are capable of releasing a diffusible dye (dye releasing compounds) as a result of development.

The particular suitability of such dye releasing compounds is due to the ability of the dyes which have been released imagewise to be transferred to special image receptor layers to form a brilliant colour image which has no image silver or silver halide superimposed on it and therefore requires no after-treatment. The combination of a heat development Process with dye diffusion process thus provides an advantageous rapid process for the production of colour images. A recording material suitable for this purpose has been described, for example, in DE-A No. 3 215 485.

According to the aforesaid publication, a recording material having a layer which contains a combination of silver halide, silver benzotriazole, a dye releasing compound and guanidine trichloroacetate (base donor) is exposed imagewise and then subjected to a heat treatment in contact with an image receptor sheet, and the dye which is released imagewise is transferred to the image receptor sheet. For the production of multicoloured images it is necessary to provide several such combinations and the silver halide in each of these combinations is sensitive to a different spectral region of light and according to its particular spectral sensitivity is associated with a particular dye releasing compound capable of releasing a dye of a different colour, in most cases a dye which is complementary to the colour of the light to which the particular silver halide is predominantly sensitive. Such associations may be arranged one above the other in different layers.

It is known to carry out the heat development process in the presence of suitable compounds, so-called melt formers or thermal solvents as described, for example, in RESEARCH DISCLOSURE Publications No. 15 027 (October 1976), No. 15 108 (November 1976) and No. 17 029 (June 1978) or in DE-A No. 3 339 810, EP-A No. 0 119 615 or EP-A No. 0 122 512. The above mentioned compounds are generally solid under normal conditions but molten at the elevated temperatures of heat treatment and promote the development processes by virtue of their dipolar character. The so-called thermal solvents are generally compounds having a protic character. Although heat treatment may be carried out dry when the aforesaid thermal solvents are used, i.e. without moistening the recording materials or the image receptor sheets, and satisfactory results can be obtained under these conditions, it is desired to obtain a further improvement to this process so as to reduce the time required for treatment and/or achieve higher colour transfer densities.

The present invention relates to a heat development process for the production of colour images, in which an imagewise exposed colour photographic recording material having at least one layer of binder which is arranged on a layer support and contains light-sensitive silver halide, optionally in combination with a substantially light-insensitive silver salt, and at least one non-diffusible, colour producing compound capable of releasing a diffusible dye as a result of development, is developed by heat treatment in the presence of a thermal development and diffusion promoting agent, the dye which is released imagewise from the non-diffusible colour producing compound being transferred to an image receptor layer which is capable of absorbing diffusible dyes, characterised in that the thermal development and diffusion promoting agent corresponds to the following formula I

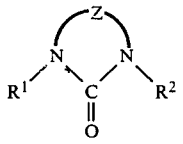

(I)

wherein $R^1$,$R^2$ denote alkyl, cycloalkyl, aralkyl, aryl or acyl and

Z denotes a group for completing a saturated heterocyclic ring having 5 to 11 ring members.

The invention also relates to a colour photographic recording material which is suitable for the heat development process and contains at least one thermal development and diffusion-promoting agent of the type indicated in at least one of its layers.

$R^1$ and $R^2$ may be identical or different. Together they have at least two carbon atoms and not more than 20 carbon atoms, preferably not more than 8 carbon atoms.

An alkyl group represented by $R^1$ or $R^2$ may be straight chained or branched and may be substituted and preferably contains 1 to 4 carbon atoms. Examples include methyl. ethyl, propyl, isopropyl, n-butyl, s-butyl, methoxymethyl, cyclohexylmethyl and hydroxyethyl. Cyclohexyl is an example of a cycloalkyl group represented by $R^1$ or $R^2$. Benzyl is an example of an aralkyl group represented by $R^1$ and $R^2$. The aryl group represented by $R^1$ or $R^2$ may be, for example, phenyl, tolyl, methoxyphenyl or N-methyl-N-acetylamino-phenyl.

An acyl group represented by $R^1$ or $R^2$ may be derived from aliphatic or aromatic carboxylic or sulphonic acids or from carbamic or sulphamic acids. Acetyl and methylsulphonyl are examples.

The group Z for completing a heterocyclic ring may in particular be an alkylene group containing at least 2 carbon atoms and preferably not more than 10 carbon atoms, and the ring formed with the urea group preferably has 5 to 7 ring members. Such an alkylene group may be straight chained or branched and may be substituted by hydroxyl, cycloalkyl, aryl or heterocyclic groups.

Z is preferably an alkylene group having the structure

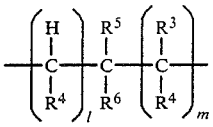

wherein $R^3$, $R^4$, $R^5$ and $R^6$ may denote, independently of one another, hydrogen or an alkyl group with up to 6 carbon atoms, preferably methyl or ethyl, and l and m may have the value 0, 1 or 2 but they cannot both be 0.

The thermal development and diffusion promoting agents according to the invention (hereinafter denoted by the acronym TEDM=thermisches Entwicklungs- und Diffusionsförderungsmittel) evidently act as a solvating medium under the conditions of heat development to assist the ongoing reactions such as development of the silver halide or of the organic silver salt under the influence of a reducing agent, release of the diffusible dyes from the colour producing compounds and diffusion of the dyes into an image receptor layer. By suitable variation of substituents $R^1$ to $R^6$, in particular of the substituents $R^1$ and $R^2$, the solvent properties of the TEDM according to the invention can be influenced as desired to render them more hydrophilic or more hydrophobic.

Suitable examples of the thermal development and diffusion-promoting agents (TEDM) according to the invention are shown below:

1

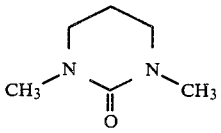

2

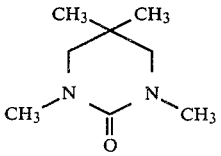

3

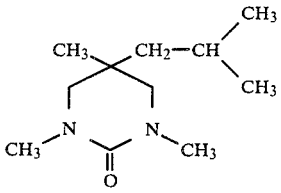

4

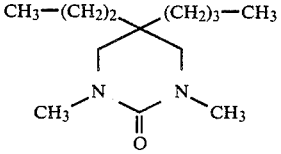

5

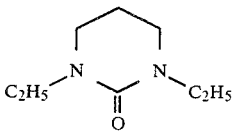

-continued

6

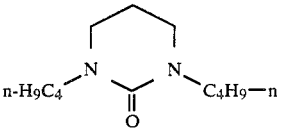

7

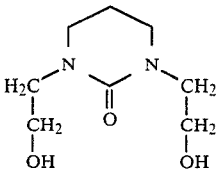

8

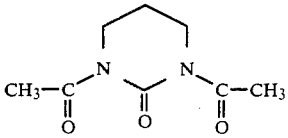

9

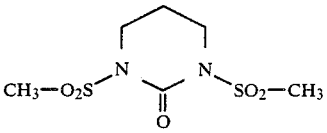

10

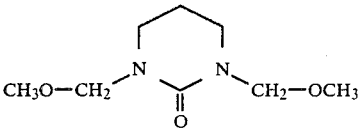

11

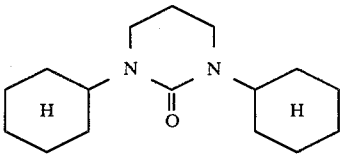

12

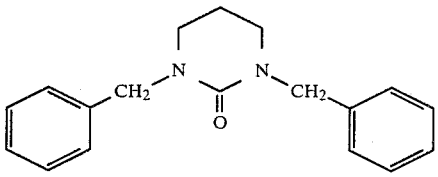

13

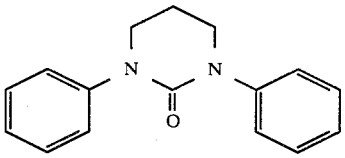

14

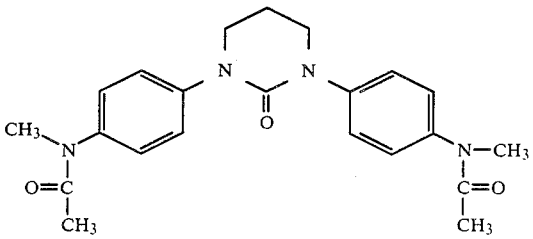

-continued
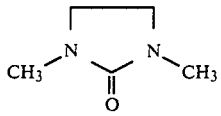
16
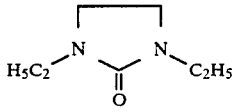
17
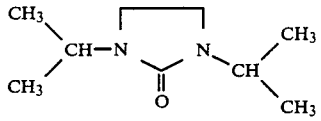
18
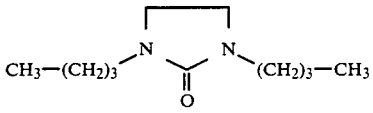
19
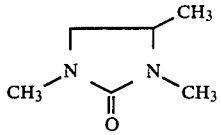
20
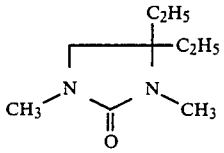
21
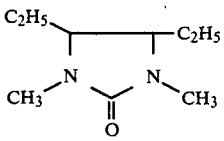
22
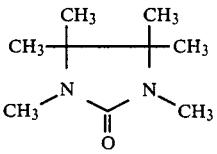
23
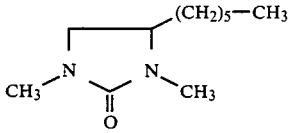
24
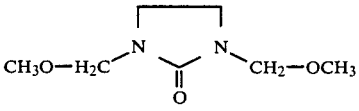
25
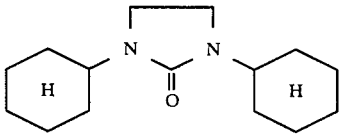
-continued
26
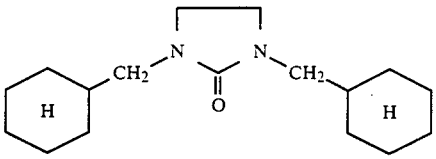
27
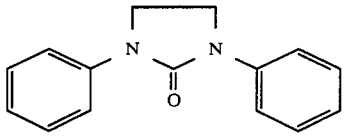
28
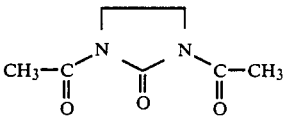
29
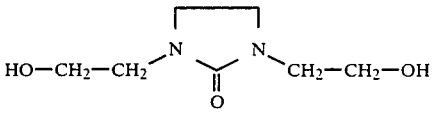
30
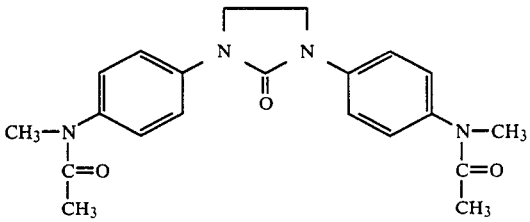
31
$(CH_2)_4$
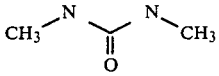
32
$(CH_2)_5$
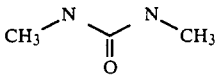
33
$(CH_2)_6$
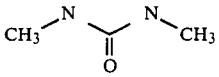
34
$(CH_2)_7$
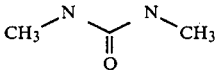
35
$(CH_2)_8$
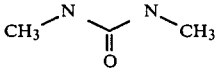
Particularly preferred examples of the TEDM according to the invention, such as compounds 1 and 15, are cyclic N,N'-dialkylureas which have been described, for example, in the literature under the chemical acronym DMPU (=dimethylpropylene-urea) or DMEU (=dimethyl-ethylene-urea).

DMPU has in most recent times been found in organic chemistry to be a solvent equivalent to HMPTA (=hexamethylphosphoric acid triamide). There is the further very important advantage that cyclic ureas are physiologically harmless(as confirmed for DMPU, for example, in Nachr. chem. Techn. Lab. 33 (1985), No.5, 396).

The accessibility of cyclic ureas and their preliminary stages is known. Some literature references are given below.

Boon, Chem. Soc. 1947, 307, 315; U.S. Pat. No. 2,422,400 (1944): Marstell, Frost, J.Amer.Chem.Soc. 72 [1950], 1032; U.S. Pat. No. 2,847,418 (1955); Hall, Schneider, J.Amer.Chem.Soc. 80 [1958], 6409, 6412; Kirkewool, Wright, J.Amer.Chem.Soc. 76 [1954] 1836, 1839); U.S. Pat. No. 2,398,284 [1943]: U.S. Pat. No. 2,373,136.

The TEDM of an aprotic type used according to the invention are predominantly liquid under normal conditions (and in this respect differs from the previously known thermal solvents, which are solid at normal temperature) and by virtue of their high solubility in water may in most cases be added directly, either without dilution or as aqueous solutions, to the casting solutions for light-sensitive or light-insensitive layers. If a TEDM is insoluble in water, it may be introduced in the form of dispersions. These may be dispersions of the pure substances or dispersions of solutions of the pure substances in a high boiling organic solvent (=oil former).

The quantity put into the process may vary within a wide range and depends inter alia on whether the compounds are distributed over several or all of the layers of the recording material according to the invention or concentrated in a particular layer. The quantity required per square metre also depends, of course, on the quantity of binder used. The man in the art can easily determine suitable concentrations by simple, routine tests. Based on the quantity of binder, the substances may be used at concentrations of 2 to 100% by weight but are preferably used at concentrations of 20 to 50% by weight. Overdosing with TEDM generally results in too dense a colour fog ($D_{min}$).

A colour photographic recording material suitable for carrying out the heat development process according to the invention contains, on a dimensionally stable layer support, at least one layer of binder containing a light-sensitive silver halide, optionally in combination with a substantially light-insensitive silver salt and a non-diffusible colour producing compound which is capable of producing a diffusible dye as a result of heat development, and the colour photographic recording material in addition contains, in one of its layers, one or more of the thermal development and diffusion promoting agents (TEDM) according to the invention.

An essential constituent of the heat developable recording material according to the present invention is the silver halide, which may consist of silver chloride, silver bromide, silver iodide or mixtures thereof having a particle size of from 0.01 to 2.0 μm, preferably from 0.1 to 1.0 μm. It may be present in the form of unsensitized silver halide or it may be chemically and/or spectrally sensitized by suitable additives.

The quantity of light-sensitive silver halide in the particular layer may range from 0.01 to 2.0 g per $m^2$ but owing to its catalytic function (as exposed silver halide) the actual quantity of silver halide used in some embodiments lies mainly in the lower part of the given range.

The silver salt which is substantially insensitive to light may be, for example, one which is comparatively stable in the presence of light, e.g. an organic silver salt. Suitable examples of such salts include the silver salts of aliphatic and aromatic carboxylic acids and the silver salts of heterocyclic compounds containing nitrogen as well as the silver salts of organic mercapto compounds.

The following are preferred examples of silver salts of aliphatic carboxylic acids: Silver behenate, silver stearate, silver oleate, silver laurate, silver caprate, silver myristate, silver palmitate, silver maleate, silver fumarate, silver tartrate, silver furoate, silver linolate, silver adipate, silver sebacate, silver succinate, silver acetate and silver butyrate. The carboxylic acids of these silver salts may be substituted, for example by halogen atoms, hydroxyl groups or thioether groups.

The following are examples of silver salts of aromatic carboxylic acids and other compounds containing carboxyl groups: Silver benzoate, silver-3,5-dihydroxybenzoate, silver-o-methylbenzoate, silver-m-methylbenzoate, silver-p-methylbenzoate, silver-2,4-dichlorobenzoate, silver acetamidobenzoate, silver gallate, silver tannate, silver phthalate, silver terephthalate, silver salicylate, silver phenylacetate, silver pyromellitate, silver salts of 3-carboxymethyl-4-methyl-4-thiazoline-2-thione and similar heterocyclic compounds. Silver salts of organic mercaptans are also suitable, e.g. the silver salts of 3-mercapto-4-phenyl-1,2,4-triazole, 2-mercaptobenzimidazole, 2-mercaptobenzothiazole, 2-mercaptobenzoxazole, 2-mercaptooctadiazole, mercaptotriazine and of thioglycollic acid as well as the silver salts of dithiocarboxylic acids, e.g. of dithioacetic acid.

The silver salts of compounds containing an imino group are also suitable. Preferred examples of these compounds include the silver salts of benzothiazole and its derivatives, e.g. silver salts of alkyl- and/or halogen-substituted benzotriazoles such as the silver salts of methyl-benzotriazole and 5-chlorobenzotriazole, as well as the silver salts of 1,2,4-triazole, 1-H-tetrazole, carbazole and saccharine and the silver salts of imidazole and its derivatives.

The quantity of substantially light-insensitive silver salts to be applied according to the invention is in the range of 0.05 to 5 g per $m^2$ in the particular layer in which it is used. The substantially light-insensitive silver salt and the light-sensitive silver halide may be present side by side as separate particles or they may be present in a combined form which may be produced, for example, by treating a substantially light-insensitive silver salt in the presence of halide ions so that light-sensitive centres of light-sensitive silver halide form on the surface of the particles of substantially light-insensitive silver salt by a process of double conversion, see U.S. Pat. No. 3,457,075.

The substantially light-insensitive silver salt serves as a reservoir for metal ions which are reduced to elementary silver under the catalytic influence of imagewise exposed silver halide when heat development takes place in the presence of a reducing agent, and act as oxidizing agents (for the reducing agent present) under these conditions.

Another essential component of the recording material according to the invention is the non-diffusible colour producing compound which is capable of releasing a diffusible dye by a redox reaction in the course of development and which will hereinafter be referred to as dye releasing compound.

The dye releasing compounds used according to the invention may be any one of the different types of compounds which are all distinguished by a connecting member which connects a dye residue to a carrier group containing a ballast group and which is redox dependent in the strength of its linkage.

A comprehensive survey of this subject may be found in Angew. Chem. Int. Ed. Engl. 22 (1983), 191–209, in which the most important of the known systems are described.

Particularly advantageous redox active dye releasing compounds are those which may be represented by the formula

BALLAST—REDOX—DYE wherein

BALLAST denotes a ballast group,

REDOX denotes a redox.active group, i.e. a group which is oxidizable or reducible under the conditions of alkaline development and which is subject to varying degrees, depending on whether it is in the oxidized or reduced state, to an elimination reaction, a nucleophilic displacement reaction, hydrolysis or some other splitting reaction by which the DYE residue is split off, and DYE denotes the residue of a diffusible dye, e.g. a yellow, magenta or cyan dye, or the residue of a dye precursor.

Ballast groups enable the dye releasing compounds according to the invention to be incorporated in a diffusion-fast form in the hydrophilic colloids conventionally fast form in the hydrophilic colloids conventionally used in photographic materials. These groups are preferably organic groups, generally straight chained or branched aliphatic groups generally containing 8 to 20 carbon atoms and optionally also containing carbocyclic or heterocyclic and in some cases aromatic groups. These groups are connected to the remainder of the molecule either directly or indirectly, e.g. by way of one of the following groups: NHCO, $NHSO_2$, NR wherein R denotes hydrogen or alkyl, O or S. The ballast group may in addition contain water-solubilizing groups such as sulpho groups or carboxyl groups, and these may be present in an anionic form. Since the diffusion properties depend on the molecular size of the whole compound, it is in some cases sufficient to use relatively short-chained groups as ballast groups, e.g. if the molecule as a whole is large enough.

Redox-active carrier groups having the structure of BALLAST-REDOX-and corresponding dye releasing compound are known in a variety of forms. A detailed description need not be given here in view of the survey given in Angew. Chem. Int. Ed. Engl. 22 (1983) 191–209.

Some examples of redox-active carrier groups from which a dye residue is split off as a result of imagewise oxidation or reduction are given below purely for illustration:

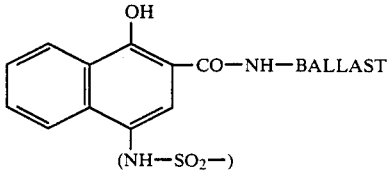

-continued

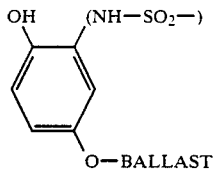

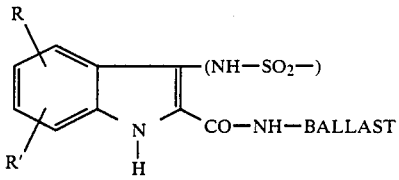

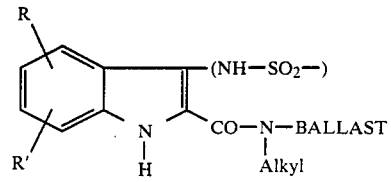

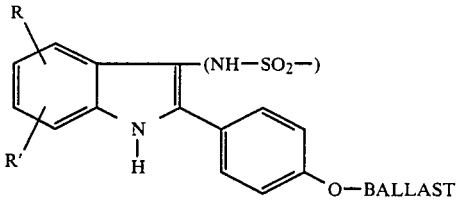

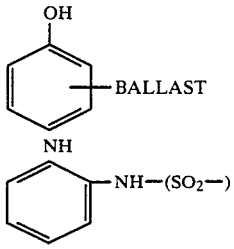

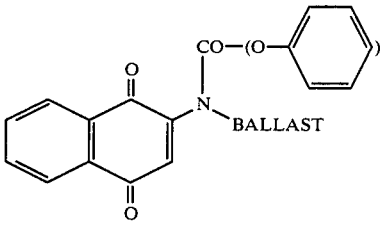

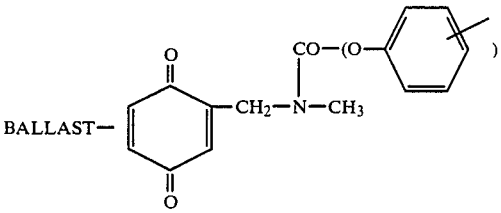

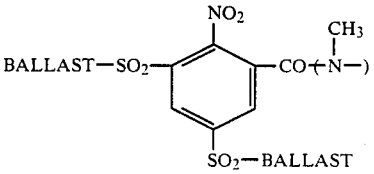

-continued

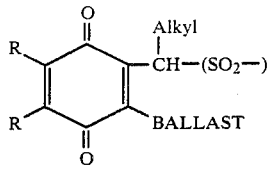

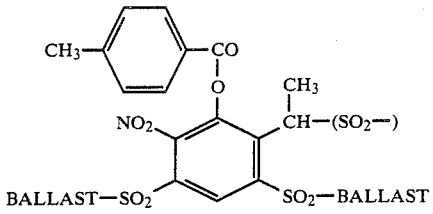

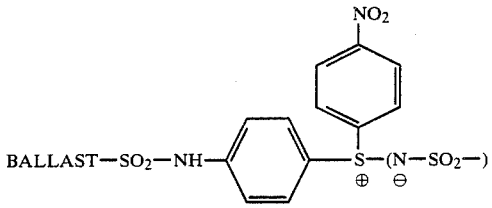

The groups in brackets are functional groups of the dye residue and are separated together with this residue from the remaining part of the carrier group. The functional group may be a substituent which has a direct influence on the absorption properties and possibly also complexforming properties of the released dye. On the other hand, the functional group may be separated from the chromophore of the dye by an intermediate or connecting member. Lastly, the functional group may be of some importance, in some cases together with the intermediate member, for the diffusion and mordanting properties of the released dye. Alkylene and arylene groups, for example, are suitable intermediate members.

The dye residues may in principle be taken from any classes of dyes, provided they are sufficiently diffusible to be capable of diffusing from the light-sensitive layer of the light-sensitive material into an image receptor layer. The dye residues may be equipped with one or more alkali solubilizing groups for this purpose. Groups suitable for rendering these residues soluble in alkali include, for example, carboxyl groups, sulpho groups, sulphonamide groups and aromatic hydroxyl groups. Such alkali solubilizing groups may be preformed in the dye releasing compounds or they may result from the release of the dye residue from the carrier group attached to ballast groups. The following are suitable dyes: Azo dyes, azomethine dyes, anthraquinone dyes, phthalocyanine dyes, indigoid dyes and triphenylmethane dyes, including dyes which are in the form of complexes or capable of forming complexes with metal ions.

The residues of dye precursors are residues of compounds which are converted into dyes in the course of the photographic process, in particular under the conditions of heat development, either by oxidation or by coupling or by complex formation or by release of an auxochromic group in a chromophoric system, for example by saponification. Dye precursors within this meaning may be leuco dyes, couplers or dyes which are converted into other dyes in the course of processing. Where it is not important to make a distinction between dye residues and residues of dye precursors, the latter are also referred to as dye residues hereinafter.

Suitable dye releasing compounds are described, for example, in the following: U.S. Pat. Nos. 3,227,550, 3,443,939, 3,443,940, DE-A No. 1 930 215, DE-A No. 2 242 762, DE-A No. 2 402 900, DE-A No. 2 406 664, DE-A No. 2 505 248, DE-A No. 2 543 902, DE-A No. 2 613 005, DE-A No. 2 645 656, DE-A No. 2 809 716, DE-A No. 2 823 159, BE-A No. 861 241, EP-A No. 0 004 399, EP-A No. 0 004 400, DE.A No. 3 008 588, DE-A No. 3 014 669 and GB-A No. 8 012 242.

In some embodiments of the heat development process according to the invention, the dye releasing compounds may be present in a form which is oxidizable or capable of coupling whereas in others they may be present in a reducible form. Depending on whether the dye is released from the oxidized or the reduced form of dye releasing compound, the copy obtained from the original will be a negative or a positive copy when conventional, negatively operating silver halide emulsions are used. It is therefore possible to produce either positive or negative images as desired by suitable choice of the dye releasing systems.

Oxidizable dye releasing compounds suitable for the heat developable recording materials according to the invention are described, for example, in DE-A No. 2 242 762, DE-A No. 2 505 248, DE-A No. 2 613 005, DE-A No. 2 645 656 and GB-A No. 8 012 242.

If the dye releasing compound is oxidizable, it constitutes a reducing agent which is oxidized by the silver halide which has been exposed imagewise or by the substantially light insensitive silver salt under the catalytic influence of the imagewise exposed silver halide, either directly or indirectly by the action of electron transfer agents ETA. Oxidation results in an imagewise differentiation in the capacity to release the diffusible dye. If, on the other hand, the dye releasing compound is reducible, then it is advantageously used in combination with a reducing agent which is present in a limited quantity, i.e. a so-called electron donor compound or an electron donor precursor compound, which in that case is present in the same layer of binder as the dye releasing compound, the light-sensitive silver halide and optionally the substantially light-insensitive silver salt. The assistance of electron transfer agents may also be advantageous when reducible dye releasing compounds are used in combination with electron donor compounds.

For producing positive colour images from positive originals when negative silver halide emulsions are used it is suitable, for example, to use a recording material according to the invention which contains reducible dye releasing compounds corresponding to the following formula:

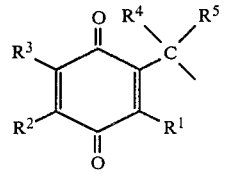

"Carquin"

wherein $R^1$ denotes alkyl or aryl, $R^2$ denotes alkyl, aryl or a group which together with $R^3$ forms a condensed ring, $R^3$ denotes hydrogen, alkyl, aryl, hydroxyl, a halogen such as chlorine or bromine, amino, alkylamino, dialkylamino including cyclic amino groups (such as piperidino, morpholino), acylamino, alkylthio, alkoxy, aroxy, sulpho or a group which together with $R^2$ completes a condensed ring, $R^4$ denotes alkyl and $R^5$ denotes alkyl or, preferably, hydrogen, and at least one of the groups $R^1$ to $R^4$ contains a ballast group.

Reducible dye releasing compounds of this kind and others which are also suitable for the purpose of the present invention are described, for example, in DE-A No. 2 809 716, EP-A No. 0 004 399, DE-A No. 3 008 588 and DE-A No. 3 014 669.

The electron donor compound used in combination with a reducible dye releasing compound at the same time serves as a reducing agent for the silver halide, the substantially light-insensitive silver salt and the dye releasing compound. Owing to the fact that the substantially light-insensitive silver salt and the dye releasing compound compete with each other in the oxidation of the electron donor compound but the former is always superior to the latter in the presence of exposed silver halide, it is the silver halide present which determines, according to a previous imagewise exposure, the areas of image within which the dye releasing compound is converted into its reduced form by the electron donor compound.

Under the conditions of development, in the present case when the imagewise exposed colour photographic recording material is heated, the electron donor compound which is present in a limited quantity is oxidized by the substantially light-insensitive silver salt and the light-sensitive silver halide under the catalytic action of the latent image nuclei which have been produced in the silver halide by exposure, this oxidation depending on the degree of exposure which has taken place, and the electron donor compound is then no longer available for a reaction with the dye releasing compound. This results in an imagewise distribution of unused electron donor compound.

Substances which have been described as electron donor compounds include, for example, non-diffusible or only slightly diffusible derivatives of hydroquinone, of benzisoxazolone, of p-aminophenol and of ascorbic acid (e.g. ascorbyl palmitate) (DE-A No. 2 809 716).

Other examples of electron donor compounds are known from DE-A No. 2 947 425, DE-A No. 3 006 268, DE-A No. 3 130 842, DE-A No. 3 144 037, DE-A No. 3 217 877, EP-A No. 0 124 915 and Research Disclosure 24 305 (July 1984). It has been found that the above-mentioned electron donor compounds also satisfy the requirements under the conditions of heat development and are therefore suitable electron donor compounds for the purpose of the present invention.

Particularly suitable are those electron donor compounds which are formed in the layer from electron donor precursor compounds under the conditions of heat development, i.e. electron donor compounds which before development are present in the recording material only in a masked form in which they are virtually ineffective. The initially inactive electron donor compounds are converted into their active form under the conditions of heat development, for example by the hydrolytic removal of certain protective groups. In the present case, the term "electron donor compound" is to be understood to include also the aforesaid electron donor precursor compounds.

The above-mentioned essential constituents of the recording material used in the process according to the invention, namely the light-sensitive silver halide, the substantially light-insensitive, reducible silver salt optionally present and the dye releasing compound, optionally in combination with an electron donor compound, are present side by side as a dispersion in a binder. The binders may be hydrophobic or hydrophilic but hydrophilic binders are preferred, especially gelatine although this may be partly or completely replaced by other, naturally occurring or synthetic binders. Polyurethanes, for example, have proved to be suitable binders, optionally in combination with gelatine, as described, for example, in German Patent Application No. P 35 30 156.2.

For the production of monochrome colour images. one or more dye releasing compounds which release dyes of a particular colour are associated with the light-sensitive silver halide and optionally light-insensitive silver salt in the light-sensitive layer of binder. The colour finally obtained may result from a mixture of several dyes. It is thereby possible to produce black-and-white images by accurate adjustment of several dye releasing compounds of different colours. For the production of multicoloured images, the colour photographic recording material used in the process according to the invention contains several, i.e. generally three associations of dye releasing compounds with their respective silver halides which are sensitized to different regions of the spectrum. In these associations, the region of absorption of the dye released from the dye releasing compound preferably corresponds substantially to the region of spectral sensitivity of the associated silver halide. The various associations of dye releasing compounds with silver halide may be accommodated in different layers of binder of the colour photographic recording material, in which case separating layers of a water-permeable binder such as gelatine are preferably placed between these different layers of binder, mainly to separate the different associations from one another and thus prevent colour deviation. In such a case, the colour photographic recording material used in the process according to the invention may contain, for example, a light-sensitive layer of binder in which the silver halide is mainly sensitive to red due to spectral sensitization, another light-sensitive layer of binder in which the silver halide is predominantly sensitive to green as a result of spectral sensitization and a third light-sensitive layer of binder in which the silver halide is predominantly sensitive to blue either due to its intrinsic sensitivity or as a result of spectral sensitization. The electron donor compounds optionally present in the three light-sensitive layers may be identical or different.

Each of the above-mentioned associations of light-sensitive silver halide, substantially light-insensitive silver salt (if present) and dye releasing compound may also be used in the form of a so called complex coacervate.

A complex coacervate is a form of dispersion in which a mixture of the required constituents is enclosed in a common shell of hardened binder. Dispersions of this kind are also known as packet emulsions. They are obtained by complex coacervation.

By "complex coacervation" is meant the occurrence of two phases when an aqueous solution of a polycationic colloid is mixed with one of a polyanionic colloid to form a concentrated colloid phase (hereinafter referred to as complex coacervate) and a dilute colloid phase (hereinafter referred to as equilibrium solution) due to an electric interaction. The complex coacervate is separated from the equilibrium solution in the form of droplets and appears as a white cloudiness. It is generally assumed that when complex coacervation is carried out in the presence of a solid such as a silver halide or fine oil droplets, the complex coacervate encloses the solid or the droplets in the interior of colloid particles. As a result, a dispersion of coacervate particles is obtained in which the solid substance (in the present case the light-sensitive silver halide and, if present, the substantially light-insensitive silver salt) and oily droplets of a solution of the organic constituents (in the present case the dye releasing compounds and optionally other auxiliary substances) are enclosed. The process is followed by hardening with a hardener so that the original form of the particles is not destroyed in the subsequent stages carried out for producing the photographic recording material, such as preparation of the casting solution and coating. The dispersion is advantageously cooled prior to hardening to a temperature of 25° C. or lower, preferably 10° C. or a lower, as a packet emulsion of good quality is thereby obtained.

Methods for the preparation of a packet emulsion in which a colour producing substance is incorporated by complex coacervation are described, for example, in U.S. Pat. Nos. 3,276,869 and 3,396,026.

The use of packet emulsions enables several emulsion components differing in their spectral sensitivity and the corresponding dye releasing compounds to be accommodated in a single layer of binder without the spectral association being lost and hence without any resulting colour deviation. This can be achieved because the amount of exposure of a particular silver halide particle almost exclusively determines the amount of dye released from that dye releasing compound which is present in the same coacervate particle (packet) as the silver halide. The use of packet emulsions thus enables a blue-sensitive, a green-sensitive and a red-sensitive silver halide emulsion, optionally together with additional, substantially light-insensitive, silver salt and spectrally associated dye releasing compounds to be accommodated in the same layer of binder without any risk of serious colour deviation.

In addition to the components already mentioned, the colour photographic recording material used in the process of the invention may contain other constituents and auxiliary agents which may be required, for example, for carrying out the heat treatment and the concomitant transfer of colour. These additional constituents or auxiliary substances may be contained in a light-sensitive layer or in a light-insensitive layer.

These auxiliary substances may include, for example, auxiliary developers, which generally have a developing action on exposed silver halide. In the present case, they mainly promote the reaction between the exposed silver salt (=silver salt in the presence of exposed silver halide) and the reducing agent, which is identical to the dye releasing compound when the latter is oxidizable but reacts with the dye releasing compound when the latter is reducible. Since these reactions mainly consist of a transfer of electrons, the auxiliary developers are also referred to as electron transfer agents ETA. Examples of suitable auxiliary developers include hydroquinone, pyrocatechol, pyrogallol, hydroxylamine, ascorbic acid, 1-phenyl-3-pyrazolinone and derivatives thereof. Since the auxiliary developers also exert a catalytic function, they need not be present in stoichiometric quantities. The presence of up to half mol of auxiliary developer per mol of dye releasing compound in the layer is generally sufficient. The auxiliary developer may be incorporated in the layer, for example, from solutions in water-soluble solvents or in the form of aqueous dispersions which have been obtained with the aid of oil formers.

Other auxiliary substances include, for example, basic compounds or compounds capable of releasing basic compounds when heat treated. Examples include sodium hydroxide, potassium hydroxide, calcium hydroxide, sodium carbonate, sodium acetate and organic bases, in particular amines such as trialkylamines, hydroxyalkylamines, piperidine, morpholine, dialkylaniline, p-toluidine, 2-picoline, guanidine and salts thereof, in particular salts with aliphatic carboxylic acids. Due to these basic compounds becoming available, the heat treatment produces a suitable medium in the light-sensitive layer and the adjacent layers for releasing the diffusible dyes from the dye releasing compounds and enabling them to be transferred to the image receptor sheet.

The auxiliary substances may also include, for example, compounds which are capable of releasing water under the action of heat. These include in particular inorganic salts containing water of crystallisation, e.g. $Na_2SO_4.10H_2O$, $NH_4Fe(SO_4)_2.12H_2O$ and compounds of the type of sodium benzotriazolate which crystallise as complexes with varying quantities of water (up to 24 mol $H_2O$); these have been described in U.S. Pat. No. 4,418,139.

The water released on heating promotes the development and diffusion processes required for production of the image.

The TEDMs described earlier in the text are also important auxiliary substances for the purpose of the present invention. These compounds, however, need not necessarily be present in the same layer as the light-sensitive silver halide and the dye releasing compounds. It is sufficient if any layer of binder which is in contact with the light-sensitive layers during the heat treatment contains the required quantity of the aforesaid TEDMs. On heating, the TEDM forms a suitable solubilizing medium assisting the development and dye diffusion processes, at least in those layers which take part in the development and dye diffusion processes. The TEDM according to the invention may thus be present in a light-sensitive layer containing silver halide and a colour producing compound or in a light-insensitive layer of binder or in several of the aforesaid layers but it may also be contained in an image receptor layer which is situated on the same layer support as the light-sensitive layers and together with these layers form a component of an integral recording material. Furthermore, the TEDM may be present in an image receptor layer of a separate image receptor material, provided only that contact is established with the light-sensitive layers of the heat developable photographic recording material during the heat treatment.

Lastly, the TEDM according to the invention may be present in a dispersed form in an auxiliary sheet which is brought into contact with the light-sensitive recording material and together with this material is subjected to a heat treatment. A process of this kind is described, for example, in German Patent Application P 35 23 361.3.

Without departing from the scope of the invention, the TEDM according to the invention may be used in combination with one or more of the so-called thermal solvents known in the art such as those described, for example, in DE-A No. 3 339 810, EP-A No. 0 119 615 and EP-A No. 0 122 512.

Development of the imagewise exposed colour photographic recording material according to the invention covers the partial steps of silver halide development, production of an imagewise distribution of diffusible dyes and transfer of this imagewise distribution into the image receptor layer by diffusion. This development is initiated by subjecting the exposed recording material to a heat treatment in which the light-sensitive layer of binder is raised to a temperature e.g. in the region of 80° to 250° C. for a period of about 0.5 to 300 seconds. Suitable conditions for the development processes, including dye diffusion, are thereby provided in the recording material without the use of a liquid medium, e.g. in the form of a developer bath. Diffusible dyes are released imagewise from the dye releasing compound in the course of development and transferred to an image receptor layer which is either an integral constituent of the colour photographic recording material according to the invention or is in contact with this material at least during the time of development. Imagewise development of silver, release of dye and transfer of colour thus take place synchronously in a one-step development process.

Production of the colour image may also take place by a two-step development process with the colour photographic recording material according to the invention, in which case silver halide development and dye release take place in a first step and transfer of the colour image from the light-sensitive part to an image receptor part in contact therewith in a second step, e.g. by heating to a temperature of from 50° to 150° C., preferably from 70° to 90° C., in which case diffusion auxiliaries (solvents) may be applied externally before lamination of the light-sensitive part with the image receptor part.

The image receptor layer may thus be arranged on the same layer support as the light-sensitive element (single sheet material) or on a separate layer support (two-sheet material). It consists mainly of a binder containing mordant for fixing the diffusible dyes which are released from the non-diffusible dye releasing compounds. The mordants used for anionic dyes are preferably long chained quaternary ammonium or phosphonium compounds, e.g. those described in U.S. Pat. Nos. 3,271,147 and 3,271,148.

Certain metal salts and their hydroxides which form difficultly soluble compounds with the acid dyes may also be used. Polymeric mordants should also be mentioned in this connection, such as those described in DE-A No. 2 315 304, DE-A No. 2 631 521 or DE-A No. 2 941 818. The dye mordants are dispersed in the mordant layer in one of the usual hydrophilic binders, e.g. in gelatine, polyvinyl pyrrolidone or partially or completely hydrolysed cellulose esters. Some binders may, of course, also function as mordants, e.g. polymers of nitrogen-containing, optionally quaternary bases, such as N-methyl-4-vinylpyridine, 4-vinylpyridine or 1-vinylimidazole, as described, for example, in U.S. Pat. No. 2,484,430. Other suitable mordanting binders are, for example, the guanylhydrazone derivatives of alkyl vinyl ketone polymers as described, for example, in U.S. Pat. No. 2,882,156, and guanylhydrazone derivatives of acyl styrene polymers as described, for example, in DE-A No. 2 009 498. The last mentioned binder, however, would generally be used in combination with other binders, e.g. gelatine.

If the image receptor layer is to be left in layer contact with the light-sensitive element after development has been completed, an alkali-permeable, light-reflective layer of binder containing pigment is generally provided between the image receptor layer and the light-sensitive element to provide an optical separation between the negative and the positive and serve as aesthetically pleasing background for the transferred positive colour image. If the image receptor layer is arranged between the layer support and the light-sensitive element and separated from the latter by a preformed light-reflective layer, then the layer support must either be transparent so that the colour transfer image produced can be viewed through this layer or the light-sensitive element and the light-reflective layer must together be removed from the image receptor layer to expose the latter. On the other hand, the image receptor layer may be arranged as the uppermost layer of an integral colour photographic recording material, in which case the material is preferably exposed through the transparent layer support.

EXAMPLE 1

Preparation of the silver salt emulsions

Emulsion 1

34.0 g $AgNO_3$ dissolved in 400 ml of water heated to 45° C. were added in the course of 2 minutes, with stirring, to a solution heated to 45° C. of 4.0 g of gelatine in 2000 ml of water containing 26.0 g of benzotriazole (BTA). The reaction mixture was then stirred for a further 5 minutes and adjusted to pH 5.0 with a 5% $Na_2CO_3$ solution. The solution was flocculated by the addition of 40 ml of a 10% polystyrene sulphonic acid solution, cooling to 25° C. and addition of 10% sulphuric acid (to pH 3.0–3.5) and then washed three times with 1000 ml portions of water. The flocculate was heated to 45° C. and adjusted to pH 6.0 with a 5% $Na_2CO_3$ solution, 10 ml of a 1% aqueous phenol solution was added and the weight made up to 870 g with water.

Emulsion 2

102.0 g of $AgNO_3$ dissolved in 600 ml of water were added in the course of 10 minutes to a solution heated to 50° C. of 120.0 g of gelatine, 271.1 g of KBr and 4.98 g of KI in 6000 ml of $H_2O$. The reaction mixture was then stirred for 20 minutes at 50° C. and cooled to 35° C. 120 ml of a 10% polystyrene sulphonic acid solution were added dropwise and the reaction mixture was then cooled to 20° C. The mixture was then flocculated by the addition of 10% sulphuric acid (to pH 3.0–3.5) and washed three times with 700 ml portions of water. The emulsion was heated to 40° C. and adjusted to pH 6.0 with a 10% sodium hydroxide solution. Final weight 3510 g.

For spectral sensitization (green sensitization), parts of Emulsion 2 (crude emulsion) were melted at 40° C., $4\times10^{-4}$ mol of green-sensitizer (in methanolic solution or slurry) were added per mol of Ag, and the mixture was left to digest in a closed vessel for about 70 minutes. The following spectral sensitizer was used.

Green sensitizer

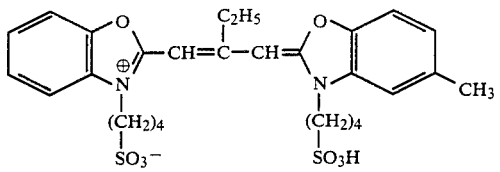

EXAMPLE 2

Preparation of the dispersions

Dispersion 1 (Dye releasing compound M-1)

50.0 g of dye releasing compound M-1 were dissolved in 25 g of diethyllaurylamide and 150 ml of ethyl acetate and finely dispersed in 330 g of a 10% aqueous gelatine solution in the presence of 2.6 g of sodium dodecylbenzene sulphonate. The auxiliary solvent was then removed with depressurized steam in a low pressure apparatus.

Yield: 834 g of Dispersion 1.

Dispersin 2 (Auxiliary developer precursor compound)

62 g of auxiliary developer precursor compound were dissolved in 120 g of diethyllaurylamide and 150 ml of ethyl acetate and dispersed in 612 g of a 10% aqueous gelatine solution in the presence of 3.5 g of sodium dodecylbenzene sulphonate. The auxiliary solvent was then removed as in the case of Dispersion 1.

Yield: 997 g of Dispersion 2.

The following compounds were used:

Dye releasing compound M-1

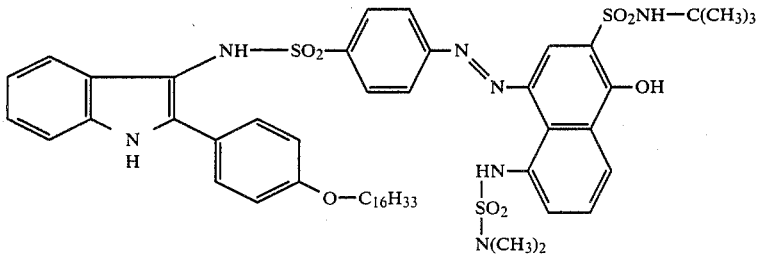

Auxiliary developer precursor compound

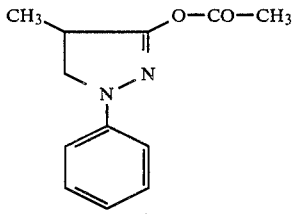

EXAMPLE 3

Image receptor part A

The image receptor part of a photographic recording material for the dye diffusion transfer process was prepared by applying the following layers in succession to a baryta paper used as layer support. The quantities given are based in each case on 1 $m^2$.

1. A mordant layer containing 2 g of polyurethane mordant of 4,4'-diphenylmethane diisocyanate and N-ethyl-diethanolamine quaternized with epichlorohydrin according to DE-A No. 2 631 521, Example 1, and 2 g of gelatine.
2. A layer of 0.6 g of gelatine and 0.6 g of sodium alginate to which a hardener has been added.

EXAMPLE 4

The light-sensitive parts of colour photographic recording materials not according to the invention (comparison) and according to the invention for the dye diffusion transfer process were prepared as follows:

Sample 1 (according to the invention)

91.2 g of Emulsion 1 are melted at 40° C. and 8.0 ml of a 4% aqueous solution of Triton ® 100× are added.

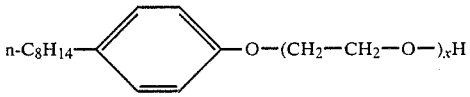

x = 9 to 10

Triton X 100
Manufacturer: Rohm + Haas Company, Philadelphia 34.4 g of Dispersion 1 (dye releasing compound M-1). 13.4 g of Dispersion 2 (auxiliary developer precursor compound), 32.2 g of 20% gelatine and 64.0 g of Emulsion 2, green-sensitized, were added successively and melted one after the other. 6.4 g of guanidine trichloroacetate dissolved in 60 ml of water and 3.2 g of Compound 15 dissolved in 7.2 g of water were finally added. The solution was applied to a layer support of polyethylene terephthalate to form a layer with a wet thickness of 50 μm and coated with a 1% aqueous gelatine solution containing a hardener (wet layer thickness 60 μm) and dried.

Sample 2 (according to the invention)

Method of preparation as for Sample 1 but using 3.2 g of Compound 1.

Sample 3 Comparison (not according to the invention)

Preparation as for Sample 1 but Compound 1 replaced by 3.2 g of water.

Sample 4 Comparison (not according to the invention)

Preparation as for Sample 1 but Compound 1 replaced by 3.2 g of Comparison Compound V

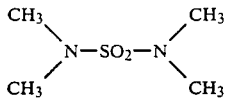

V

V: = "thermal solvent" from DE-A-3 339 810 (type sulphamide, dipolar, aprotic)

EXAMPLE 5

The samples prepared according to Example 4 were exposed to 1000 Lux of a tungsten lamp for 5 seconds through a transparent yellow filter having a density of 1.25. The samples were then heated dry to 110° C. for development (the development time is entered in the following Table). The samples were then left to swell in water for 10 seconds and laminated to the image receptor sheet (from Example 3) which had been left to swell in water for 30 to 60 seconds, and the laminated sheets were heated to 75° C. on a controlled heating bench for 2 minutes and then separated and immediately dried. Sharp, brilliant colour transfers were obtained on the image receptor sheets. The $D_{min}$ and $D_{max}$ values are shown in Table 1.

TABLE 1

| | Development time | Colour density $D_{min}$ | $D_{max}$ |
|---|---|---|---|
| Sample 1 | 30 | 0.20 | 1.27 |
| Sample 1 | 40 | 0.21 | 1.45 |
| Sample 1 | 50 | 0.23 | 1.67 |
| Sample 1 | 60 | 0.25 | 1.85 |
| Sample 2 | 50 | 0.22 | 1.64 |
| Sample 3 | 50 | 0.10 | 0.27 |
| Sample 3 | 60 | 0.11 | 0.30 |
| Sample 3 | 240 | 0.41 | 1.51 |
| Sample 3 | 480 | 1.59 | 1.73 |
| Sample 4 | 50 | 0.19 | 0.89 |
| Sample 4 | 50 | 0.23 | 1.23 |

Table 1 shows very clearly the powerful action of the compounds according to the invention as development accelerating substances.

A comparison of Samples 1 and 2 with Sample 4 shows a marked improvement in the $D_{min}/D_{max}$ relation and hence a substantially higher photographic activity with regard to $D_{max}$ development (corresponding to a marked increase in the relative photographic sensitivity) without undue rise of the $D_{min}$.

The compounds of the dipolar aprotic type used according to the invention are thus markedly superior to the thermal solvents of the state of the art due to their improved photographic properties.

We claim:

1. Heat development process for the production of colour images, in which an imagewise exposed colour photographic recording material having at least one layer of binder arranged on a layer support and containing light-sensitive silver halide, optionally in combination with a substantially light-insensitive silver salt, and at least one non-diffusible colour producing compound capable of releasing a diffusible dye as a result of development is developed by heat treatment in the presence of a thermal development and diffusion promoting agent, the dye released imagewise from the non.diffusible colour producing compound being transferred to an image receptor layer which is absorbent to diffusible dyes, characterised in that the thermal development and diffusion promoting agent corresponds to the following formula I:

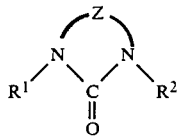

(I)

wherein $R^1$, $R^2$ denote alkyl, cycloalkyl, aralkyl, aryl or acyl and

Z denotes an alkylene group for completing a saturated heterocyclic ring having 5 to 11 ring members.

2. Process according to claim 1, characterised in that Z in the general formula denotes an optionally branched alkylene group which together with the urea group forms a 5- to 7-membered ring.

3. Process according to claim 1, characterised in that Z denotes an alkylene group having the structure

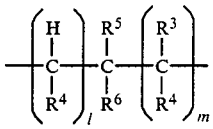

wherein $R^3$, $R^4$, $R^5$, $R^6$ denote (independently of one another) hydrogen or alkyl with up to 6 carbon atoms, and l and m represent 0, 1 or 2 but l and m must not both have the value 0.

4. Process according to claim 1, characterised in that the thermal development and diffusion promoting agent is contained in the colour photographic recording material and/or in a separate image receptor material which is in contact with the colour photographic recording material during the heat treatment.

5. Colour photographic recording material developable by heat treatment, comprising at least one layer of binder which is arranged on a layer support and contains light-sensitive silver halide, optionally in combination with a substantially light-insensitive silver salt, at least one non-diffusible colour producing compound capable of releasing a diffusible dye as a result of development by heat treatment, and at least one thermal development and diffusion-promoting agent, characterised in that the thermal development and diffusion promoting agent corresponds to the following formula I:

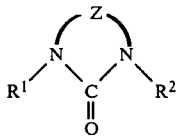

(I)

wherein $R^1$, $R^2$ denote alkyl, cycloalkyl, aralkyl, aryl or acyl and

Z denotes an alkylene group having at least 2 carbon atoms.

6. Recording material according to claim 5, characterised in that it contains, as thermal development and diffusion promoting agent, a compound corresponding to the formula given in claim 6, in which Z denotes an alkylene group having the structure corresponding to the formula

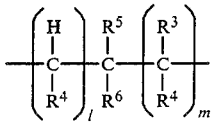

wherein $R^3$, $R^4$, $R^5$ and $R^6$ denote, independently of one another, hydrogen or alkyl with up to 6 carbon atoms and l and m have the value 0, 1 or 2, but l and m cannot both represent 0.

7. Recording material according to claim 5, characterised in that it contains N,N'-dimethyl-ethyleneurea or N,N'-dimethylpropyleneurea in at least one of its layers.

* * * * *